US006711870B1

(12) United States Patent
Richardson

(10) Patent No.: US 6,711,870 B1
(45) Date of Patent: Mar. 30, 2004

(54) GLAZING SUPPORT SYSTEMS

(75) Inventor: Christopher Richardson, Clitheroe (GB)

(73) Assignee: Ultraframe (UK) Limited, Lancashire (GB)

( * ) Notice: Subject to any disclaimer, the term of this patent is extended or adjusted under 35 U.S.C. 154(b) by 0 days.

(21) Appl. No.: 09/787,646

(22) PCT Filed: Sep. 22, 1998

(86) PCT No.: PCT/GB98/02805

§ 371 (c)(1),
(2), (4) Date: May 30, 2001

(87) PCT Pub. No.: WO01/17466

PCT Pub. Date: Mar. 30, 2000

(51) Int. Cl.[7] ..... E04B 1/61; E04C 2/34

(52) U.S. Cl. ..... 52/775; 52/774; 52/772; 52/468; 52/464; 52/395

(58) Field of Search ..... 52/775, 773, 774, 52/772, 468, 235, 204.7, 204.69, 464, 466, 395, 461, 467

(56) References Cited

U.S. PATENT DOCUMENTS

| | | | | | |
|---|---|---|---|---|---|
| 3,367,077 | A | * | 2/1968 | Johnston | 52/464 |
| 3,769,775 | A | * | 11/1973 | Brzezinsi | 52/731 |
| 4,067,155 | A | * | 1/1978 | Ruff et al. | 52/105 |
| 4,222,210 | A | * | 9/1980 | Hanstein et al. | 52/461 |
| 4,502,256 | A | * | 3/1985 | Hahn | 52/63 |
| 4,736,563 | A | | 4/1988 | Bilhorn | |
| 4,745,723 | A | * | 5/1988 | Esposito | 52/464 |
| 4,850,167 | A | * | 7/1989 | Beard et al. | 52/200 |
| 4,891,920 | A | * | 1/1990 | Pingston | 52/145 |
| 4,896,473 | A | * | 1/1990 | Kiebetrau | 52/747 |
| 4,996,809 | A | * | 3/1991 | Beard | 52/200 |
| 5,074,089 | A | * | 12/1991 | Kemmer et al. | 52/395 |
| 5,363,611 | A | * | 11/1994 | Richardson | 312/116 |
| 5,580,620 | A | * | 12/1996 | Campbell et al. | 428/34 |
| 5,655,346 | A | * | 8/1997 | Holmes et al. | 52/476 |
| 5,678,383 | A | | 10/1997 | Danielewicz | |
| 6,016,632 | A | * | 1/2000 | McGee et al. | 10/96 |
| 6,202,382 | B1 | * | 3/2001 | Conterno | 52/762 |

FOREIGN PATENT DOCUMENTS

| | | | | |
|---|---|---|---|---|
| BE | 906023 | | 4/1987 | |
| BE | 906028 | | 4/1987 | |
| EP | 92078 | A2 | 10/1983 | |
| EP | 92078 | | 10/1983 | |
| EP | 610102 | A1 | 8/1994 | |
| FR | 1266593 | | 6/1961 | |
| FR | 2093326 | | 1/1972 | |
| GB | 942774 | | 11/1963 | |
| GB | 2058896 | * | 9/1979 | E06B/3/62 |
| GB | 2115449 | * | 2/1982 | E04B/1/38 |

* cited by examiner

*Primary Examiner*—Carl D. Friedman
*Assistant Examiner*—Chi Q. Nguyen
(74) *Attorney, Agent, or Firm*—Wood, Phillips, Katz, Clark & Mortimer

(57) ABSTRACT

A glazing support system comprises first and second members. Each member has at least one wing. The members are engageable to trap a glazing panel between the wings. The first and second members are moulded of plastics material.

2 Claims, 2 Drawing Sheets

GLAZING SUPPORT SYSTEMS

TECHNICAL FIELD OF THE INVENTION

This invention concerns glazing support systems, particularly but not exclusively for use in forming glazed roofs, such as of conservatories.

Known glazing support systems for use in forming conservatory roofs generally comprise an aluminium glazing bar of inverted T-section and u-PVC top and bottom cappings. The top capping has a top and depending divergent sides and internal formations for engagement with cooperating formations of the top of the T-section glazing bar. The bottom capping is a cover for the cross bar. T-section glazing bar. Glazing panels are supported on the cross bar of the glazing bar and the top capping is pressed down onto the glazing bar to hold the panels in position. Both cappings have gaskets along edges that contact the glazing panels to form seals above and below the glazing panels. The gasket material may be co-extruded with the cappings or separate gaskets may be fitted thereto.

Thus, such glazing support systems comprise at least three components and even more when gasket material has to be added. The more components the longer it takes to form a roof using such glazing support systems.

An object of this invention is to provide an improved glazing support system.

SUMMARY OF THE INVENTION

According to a first aspect of this invention there is provided a glazing support system comprising first and second members, each member having at least one wing, the members being engageable to trap a glazing panel between said wings, characterized in that the first and second members are moulded of plastics material.

According to a second aspect of this invention there is provided a glazing support system comprising first and second members, each member having at least one wing, the members being engageable to trap a glazing panel between said wings, characterized by one member having at least one spacing means to maintain a desired spacing between wings of the first and second members.

According to a third aspect of this invention there is provided a glazing support system comprising first and second members, each member having at least one wing, the members being engageable to trap a glazing panel between said wings, characterized in that a load bearing one of said members is moulded of plastics material with moulded-in reinforcement.

Glazing support systems according to the invention preferably comprise an inverted T-section preferably comprise an inverted T-section glazing bar having a base and an upstanding limb and a capping therefor engageable on the upstanding limb of the glazing bar. The upstanding limb and interior of the capping preferably have mutually engageable formations preferably allowing for engagement of the capping on the glazing bar at different positions to accommodate different thicknesses of glazing panel.

The base of the glazing bar preferably has upstanding ends to form channels between the upstanding limb and the ends and the base top wall preferably slopes downwards towards the upstanding ends to provide for water drainage along the glazing bar. The upstanding ends preferably carry gasket material which may be co-extruded therewith. The base preferably has its underside formed with a pair of angled facets to accommodate glazing and support at hip locations as well as normal support for straight roofs.

The glazing bar may be formed with ducts therethrough or may be substantially solid. The glazing bar may be reinforced. Reinforcing members, such as metal bars, rods or the like or glass rods or fibrous reinforcements, may be fitted in ducts of the glazing bar or may be moulded into the glazing bar.

The glazing bar may be moulded by extrusion of, say, u-PVC, or may be moulded by pressing or injection moulding from other plastics material. The glazing bar may be formed with a foamed core and a rigid outer skin. Alternatively, the glazing bar may be moulded from recycled plastics material possibly containing non-plastics filler or reinforcement material.

The top capping preferably has a top and divergent side walls ending with gasket material attached or coextruded on ends of the side walls. The side walls may have first parallel parts extending normally to the top and second parts sloping away from the first parts. The engaging formations of the capping are preferably internally of the first side wall parts and may be a rib or bead on each side wall part that can be pushed past and retained under ridges on the sides of the upstanding limb of the glazing bar. The ridges are preferably situated so as to accommodate predetermined thicknesses of glazing material. The spacing means is preferably a web depending internally from the capping side wall, possibly from a sloping part of the side wall or possibly as a continuation of a first side wall part normal to the top of the capping.

In use in forming a conservatory roof a preferred glazing bar of the glazing support system of the invention is fixed at each end to supporting members, such as a ridge beam and an eaves beam and glazing panels laid on opposite sides on the upstanding ends of the base of the glazing bar on the upstanding ends of the base of the glazing bar on top of gasket material. Then the capping is pressed onto the upstanding limb until gasket material of the capping presses onto and seals against the top of the glazing panels. When present the spacing means will limit the extent to which the capping can be pressed downwards to prevent damage or distortion of the capping.

The glazing support system of the invention may also be used in forming windows in a similar way, such as by being used as mullions for window systems. For situations where a glazing panel is only required in one side of a glazing bar, such as where a glazing bar is to be abutted against a wall, the glazing bar and capping will only have one wing each and the opposite side of the glazing bar and capping will be adapted to suit attachment thereof to an adjacent surface.

BRIEF DESCRIPTION OF THE DRAWINGS

This invention will now be further described, by way of example only, with reference to the accompanying drawings, in which.

DETAILED DESCRIPTION OF THE ILLUSTRATED EMBODIMENTS

Figure 1:
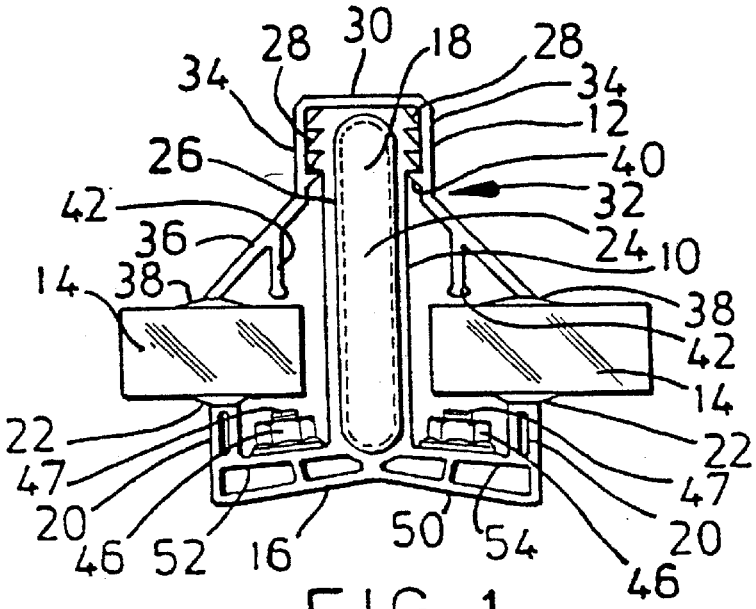
FIG. 1 is an end view of a first glazing support system according to the invention with 16 mm thick glazing panels fitted.
Figure 2:
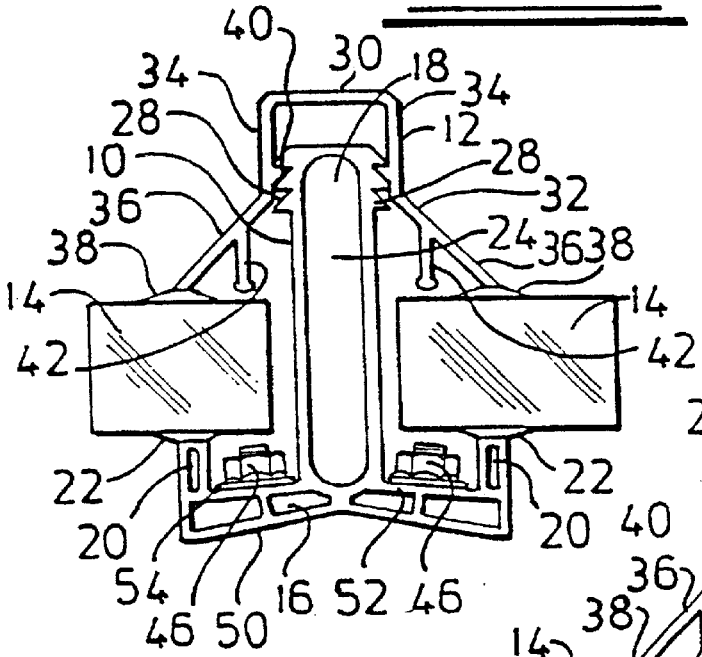
FIG. 2 shows the glazing support system of FIG. 1 with 20 mm thick glazing panels fitted.
Figure 3:
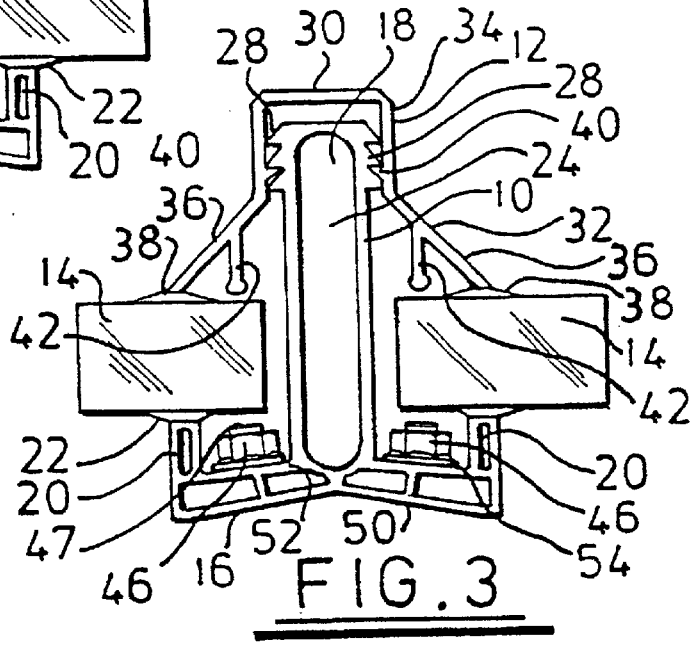
FIG. 3 shows the glazing support system of FIG. 1 with 24 mm thick glazing panels fitted.

Referring to FIGS. 1 to 3 of the accompanying drawings, a glazing support system suitable for use in forming glazed roofs or windows comprises an elongate glazing bar 10 and a capping 12 that is engageable with the bar to trap glazing panels 14 between the capping and the bar on one or both sides thereof. Both the capping and the bar are extruded of plastics material, such as u-PVC.

The bar 10 is generally an inverted T-section member having a base 16 and an upstanding limb 18. The base 16 has upturned ends 20 on which are coextruded gaskets 22. The base 16 is ducted to improve thermal performance and stiffness.

The upstanding limb 18 is twin walled forming a duct 24. For additional strength the duct 24 may receive a reinforcing member such as a formed steel or aluminium flat bar 26 shown in broken lines in FIG. 1. The top parts of the side walls of the limb 18 have a series of ridges 28 to provide fixed stepped locations for the capping 12.

The capping 12 has a top 30 and dependent sides 32 each having a first part 34 normal to the top 30 and a second part 36 angled outwards from the first part. At their free ends the sides 32 have coextruded gasket material 38 thereon.

Internally the capping 12 has near the bottom of each side wall first part 34 a rib 40. The ribs 40 locate under the appropriate ridges 28 when the capping is pressed onto the bar 10.

Depending from the second side parts 36 are webs 42. The webs 42 are sized so as to abut against the top of the glazing panels 14 to prevent the capping being pushed down too far and putting too much stress on the capping sides which may cause distortion.

The bar 10 is held down onto a frame member, such as a roof ridge member or an eaves beam, by means of nuts and bolts 46, 47 through the base 16 and into the frame member. To prevent collapsing of the ducted base 16 packing pieces (not shown) may be pushed into the ducted base to support the ducts. The bolts may be fixed also through the packing pieces. Filler pieces may also be provided to seal between the underside of the glazing bar and the supporting framework.

The base 16 is shown as having a double faceted bottom wall 50 with its two facets angled to each other. Upper wall 52 of the base also has two facets but at less of an angle to each other than the bottom wall facets. The upper wall facets at their junction with the ends 20 have longitudinal grooves 54. The slope of the upper wall facets and the grooves 54 provide a means for collecting water and draining it along the glazing bars.

The angled facets of the bottom wall 50 of the base 16 of the glazing bar make the bar suitable for use in both straight runs of conservatory roof as well as sections where glazing panels are also angled relative to each other, such as at the hip end of a Victorian style conservatory roof.

As can be seen in FIGS. 1, 2 and 3, the glazing bar system illustrated can accommodate different thicknesses of glazing panel. The capping 12 can be secured on the limb 18 at different positions by means of the ridges 28 on the limb 18 and the ribs 40 of the capping. The webs 42 ensure that the capping is secured at the appropriate position for that thickness of glazing panel.

The glazing system of FIGS. 1 to 3 is used in the following manner, for example, for forming a conservatory roof. The glazing bar 10 is secured between a ridge member and an eaves beam. Appropriately sized glazing panels 14 are laid either side of the glazing bars with their edges on top of the gasket material 22. Then a capping 12 is pressed down onto glazing panels so that the ribs of the capping engage the ridges of the limb 18 of the glazing bar until the depending webs 42 abut the tops of the glazing panels. The gasket material of the bars and the cappings are pressed onto either face of the glazing panels and seal against water penetration into the glazing bar. Even if water does penetrate into the glazing bar it is drained off along the glazing bar without settling in the glazing bar and affecting the bolts used to hold the glazing bar down.

Whilst the components of the glazing bar system of FIGS. 1 to 3 are extruded from u-PVC and can have sufficient strength for many situations due to the ducted formation of the glazing bar itself, there are various other ways of producing, in particular, the glazing bar to improve its strength.

Figure 4:
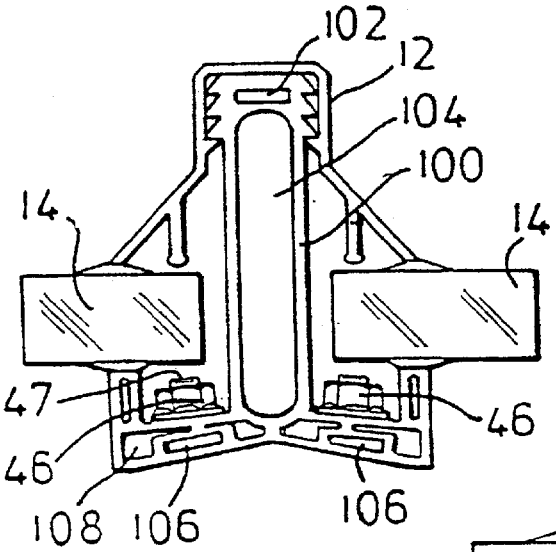
FIG. 4 is an end view of a second glazing support system according to the invention.

In FIG. 4 of the accompanying drawings, the glazing bar 100 has a metal reinforcing bar 102 moulded into the top of upstanding limb 104 and metal reinforcing bars 106 moulded into ducts in base 108 of the glazing bar 100, whereby the metal reinforcing bars 102, 106, are surrounded by the plastics material of the glazing bar 100. The metal bars 102, 106, such as of aluminium or steel, may be flat bars as shown or may be, for example, metal rods possibly used in multiples. On the other hand non-metal reinforcements may be moulded into the glazing bar 100, such as of glass or of fibrous material. Other means of fixing reinforcement in place may be used, such as fastenings or adhesive. The bars 106 in the base are advantageously positioned so that the fixing bolts 46 pass through the bars 106. The capping 12 in FIG. 4 is the same as shown in FIGS. 1 to 3.

Figure 5:
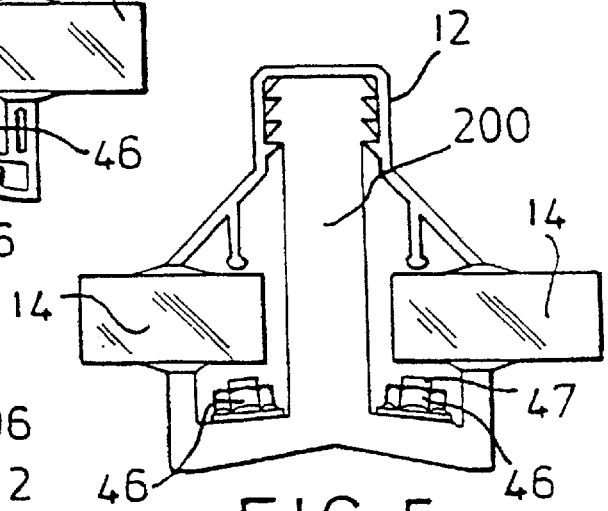
FIG. 5 is an end view of a third glazing support system according to the invention.

Turning to FIG. 5, a glazing bar 200 is formed as a solid by a pressing or an injection moulding process. The glazing bar 200 may be formed of a plastics material composite providing a foamed core having an outer skin. The plastics material used for making such a glazing bar may even incorporate recycled material and may contain non-plastics filler/reinforcing material, possibly randomly arranged. The capping 12 in FIG. 5 is the same as shown in FIGS. 1 to 3.

Figure 6:
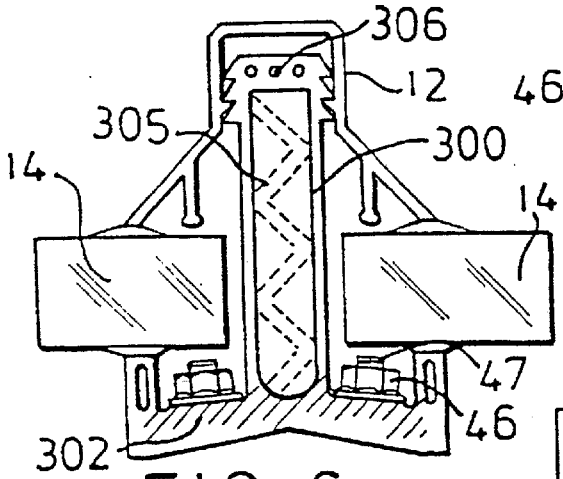
FIG. 6 is an end view of a fourth glazing sup system according to the invention.
Figure 7:
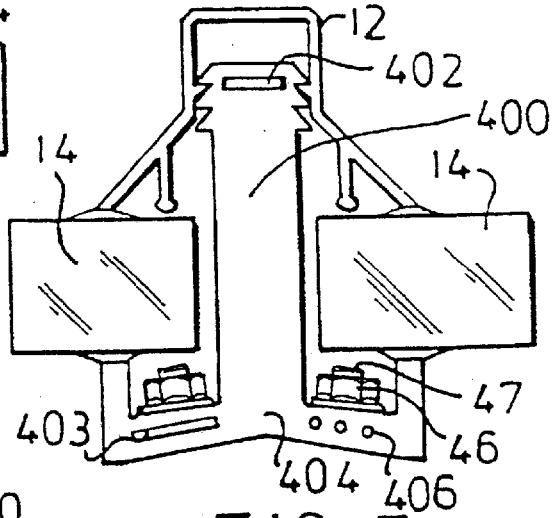
FIG. 7 is an end view of a fifrth glazing support system according to the invention.

In FIG. 6 of the accompanying drawings, a glazing bar 300 is formed with a rigid PVC skin with its base 302 formed as a PVC foam within the skin. The base 302 may include metal bar/strip or glass rod reinforcements, such as shown in FIG. 7 described below. The bar 300 has a hollow upstanding limb 304 but at its top end glass rod reinforcement 306 is moulded in. The use of the glazing bar of this embodiment is the same as for the other described embodiments. The upstanding limb 304 could include metal bar reinforcement, such as 26 shown in FIG. 1. An alternative could be to include webbing 305 included in broken lines.

FIG. 7 shows another variation of the glazing support system of the invention, in which a glazing bar 400 is formed as in the embodiment of FIG. 5 except as metal or glass rod reinforcements are moulded into ducts in the glazing bar 400. Flat metal strip reinforcement 402 is shown at the top of the glazing bar 400 and similar reinforcement is shown on one side of its base 404. Again the glazing bar 400 is used as has been described for the other illustrated embodiments.

Figure 8:
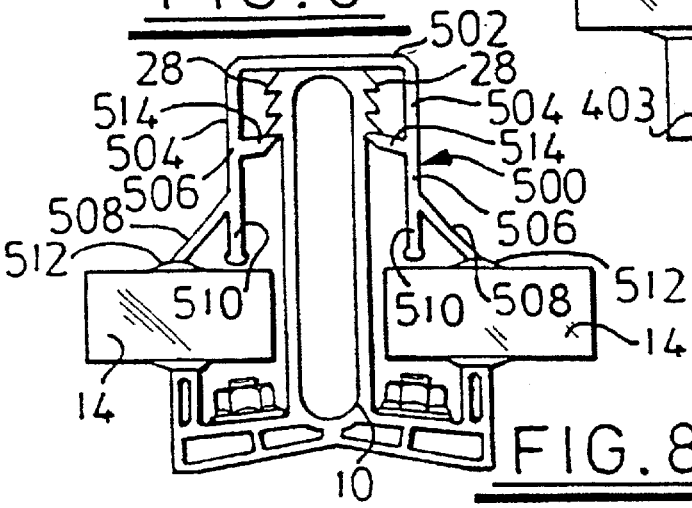
FIG. 8 shows a sixth glazing support system according to the invention.

FIG. 8 of the accompanying drawings shows an alternative form of capping 500 for a glazing support system according to the invention. The capping is shown here on a glazing bar of the type shown in FIG. 1 of the drawings but may be used on the glazing bars of any of the other illustrated embodiments of the invention. The capping 500 has a wider top 502 than the capping 12 of FIG. 1. From the top 502 depend side walls 504 having first parts 506 normal to the top and second parts 508 angled outwards. Where the two side wall parts meet effectively continuation of the first side wall parts form spacer webs 510 to prevent the capping being pushed too far downwards by abutment of the spacer webs on the glazing panels 14. Ends of the second side wall parts 508 carry coextruded gaskets 512.

The capping 500 is fixed onto the glazing bar 10 by means of internal ribs 514 that locate under the ridges 28 of the glazing bar 10 in a similar way to the capping 12 of FIG. 1.

Whilst the invention has been described in relation to glazing support systems for use in forming glazed roofs, such as of conservatories, it will be appreciated that the glazing bar system may be used for supporting glazing panels in other situations, such as in windows and glazed doors, where the glazing support can form mullions and transoms.

What is claimed is:

1. In a glazing support system, a glazing bar being of a plastics material, except that reinforcing members are in ducts of the glazing bar and are surrounded by the plastics material of the glazing bar, each reinforcing bar being of a material differing from the material of the glazing bar, wherein the reinforcing members include flat bars, through which fixing bolts pass.

2. In a glazing support system, a glazing bar being of a plastics material, except that reinforcing members are in ducts of the glazing bar and are surrounded by the plastics material of the glazing bar, each reinforcing bar being of a material differing from the material of the glazing bar, wherein the reinforcing members include flat steel or aluminum bars, through which fixing bolts pass.

* * * * *